United States Patent [19]

Bower

[11] 4,206,791

[45] Jun. 10, 1980

[54] FLUID DISPENSING NOZZLE

[75] Inventor: Allen M. Bower, Conneaut, Ohio

[73] Assignee: Emco Wheaton, Inc., Conneaut, Ohio

[21] Appl. No.: 798,023

[22] Filed: May 18, 1977

[51] Int. Cl.[2] ..... B65B 3/04

[52] U.S. Cl. ..... 141/392; 74/526; 251/90

[58] Field of Search ..... 141/1, 198, 206–229, 141/392; 251/90, 101, 111, 112, 284, 285; 74/526, 551; 24/3 E, 3 R, 73 B

[56] References Cited

U.S. PATENT DOCUMENTS

| | | | |
|---|---|---|---|
| 2,520,228 | 7/1970 | Vest et al. | 141/206 |
| 2,941,418 | 6/1960 | Esser et al. | 74/551 X |
| 3,589,413 | 6/1971 | Vest et al. | 141/206 |
| 4,060,008 | 11/1977 | Wilkinson | 74/526 X |

FOREIGN PATENT DOCUMENTS

| | | | |
|---|---|---|---|
| 573801 | 4/1959 | Canada | 74/551 |
| 309768 | 12/1918 | Fed. Rep. of Germany | 74/551 |

*Primary Examiner*—Frederick R. Schmidt
*Attorney, Agent, or Firm*—Charles L. Lovercheck

[57] ABSTRACT

A fluid dispensing nozzle having an operating lever with a lever locating means for assisting the operator in holding the hand operating lever open at one or more fixed locations. The lever may be held at a predetermined location, using a relatively small amount of effort to hold the lever. The lever will return to closed position when hand pressure on the lever is released. The nozzle is especially useful for dispensing fluid at lower than maximum flow rate in order to avoid splashing and spillage. It is especially suited for use in self-service gasoline service stations.

1 Claim, 5 Drawing Figures

FLUID DISPENSING NOZZLE

REFERENCE TO PRIOR ART

The nozzle, according to the present invention, is of the general type shown in U.S. Pat. No. 3,817,285, which shows a fixed latching mechanism for holding the nozzle open, and U.S. Pat. No. 3,938,565 which shows a mechanism for holding the nozzle open using considerably less force than otherwise would be required. The mechanism in the latter-mentioned patent is extremely complex and expensive to manufacture, and can be readily damaged. It also appears to be inconvenient to use and to require the use of both hands of the operator. The mechanism in the latter-mentioned patent describes only one position of opening, presumably that of providing the highest flow rate.

GENERAL DESCRIPTION OF THE INVENTION

In contrast to the prior art, the present invention is simple and inexpensive and the latching mechanism contains no moving parts. It is not subject to being damaged during service and provides a means of dispensing fluid at predetermined rates in order to avoid splashing and spillage. The present invention relates to a fluid-dispensing nozzle, more particularly, a gasoline dispensing nozzle for use at self-service gasoline service stations. Self-service gasoline service stations allow motorists to dispense gasoline into their own fuel tanks without the assistance of a service station attendant. The labor costs thus saved enables the dealer to sell gasoline at a lower price than at an attended service station. It is also possible for drivers to obtain gasoline with less delay as there is no need to wait for an attendant.

At conventional attended services stations, the gasoline dispensing nozzle is often equipped with a hold-open mechanism that allows the attendant to latch the operating lever in one or more open positions without requiring that the lever be held open manually during the entire filling operation. This allows the attendant to select a lower rate of filling in order to avoid splashing and spillage of the gasoline.

Safety regulations concerning the operation of self-service gasoline service stations prohibit the use of means to latch the dispensing nozzle open. That is, the driver is required to hold the nozzle open at all times while his tank is being filled.

Safety regulations also require that the gasoline dispensing nozzle be biased in a closed direction to assure that the nozzle closes and seals properly. Therefore, considerable force is required to open and hold the gasoline dispensing nozzle open. It is particularly difficult to manually hold a gasoline dispensing nozzle open at a flow rate less than maximum because as the poppet of the ordinary nozzle approaches its seat, the supply pressure acting on the poppet increases further urging the poppet closed. This effect occurs rapidly and often results in the nozzle suddenly snapping closed when an attempt is made to decrease the flow rate.

The fillernecks of some automobiles are designed in such a way that considerable splashing and spillage occurs when an attempt is made to fill at a high flow rate. Such automobiles must be filled at a lower flow rate to avoid spillage. The attendant at attended service station soon learns to latch the nozzle in a less than wide open position while fueling such automobiles. However, at self-service filling stations, the driver finds it difficult to hold the lever at other than a wide open position.

Thus, to make self-service filling stations more acceptable to drivers and safe to operate, it is necessary to provide a dispensing nozzle that is convenient and easy to use and that allows the driver to fill the automobile at a lower rate of flow when necessary. The dispensing nozzle must always close immediately whenever the operating lever is released.

The present invention provides a fluid dispensing nozzle with a lever locating device that allows the operator to select a predetermined location for the lever for dispensing fluid and it also provides that the nozzle will close immediately whenever the lever is released. The lever locating device incorporates no moving parts and the operator can operate the dispensing nozzle with one hand.

OBJECTS OF THE INVENTION

It is an object of the invention to provide an improved operating mechanism for a dispensing nozzle.

Another object of the invention is to provide an improved locating mechanism for an operating lever of a dispensing nozzle.

Another object of the invention is to provide an improved dispensing mechanism.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
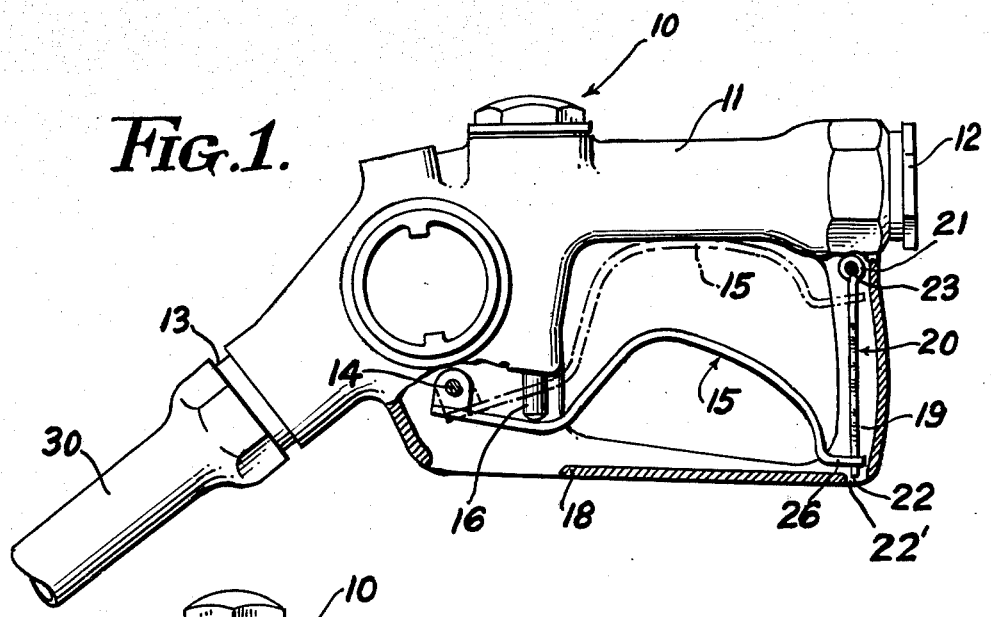
FIG. 1 is a side view of the nozzle according to the invention partly in cross section.
Figure 2:
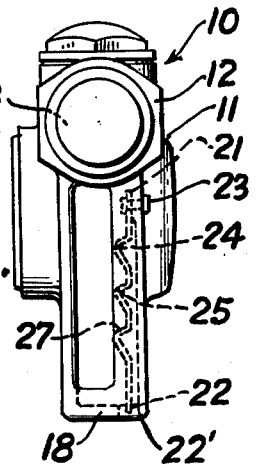
FIG. 2 is an end view of the nozzle shown in FIG. 1.
Figure 5:
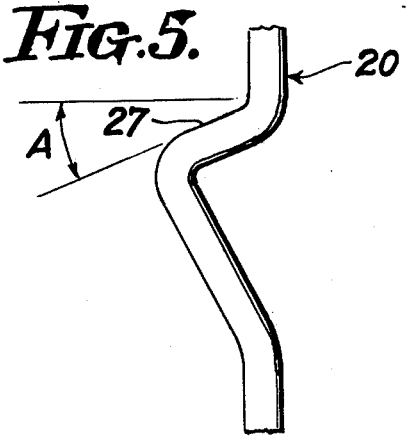
FIG. 5 is an enlarged view of one of the protrusions on the locator.
Figure 3:
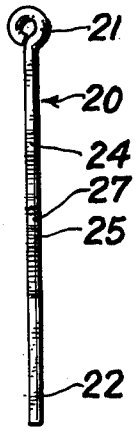
FIG. 3 is a side view of the lever locator.
Figure 4:
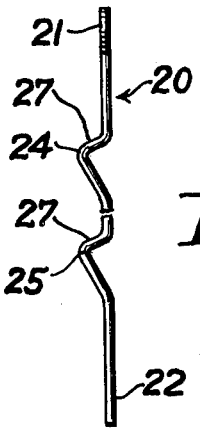
FIG. 4 is an end view of the lever locator.

Now, with more particular reference to the drawings, a fluid dispensing nozzle indicated generally at 10 as shown, having a body 11 with an inlet 12 and an outlet 13. The outlet has the dispensing spout 30. A lever 15 is swingably connected to the body at the fulcrum point 14 and engages the stem 16 of an actuator for a valve of a type familiar to those skilled in the art. The nozzle shown may be of the type shown in the U.S. Pat. No. 3,062,247, for example, which shows an automatic nozzle. However, the invention is not limited to automatic nozzles and may be used with any other type of nozzle.

a lever guard 18 is integrally attached to the body and extends upwardly at 19 and is attached to the body adjacent the inlet.

The upwardly extending part 19 of the lever guard 18 is channel shaped and has the locator 20 fixed to it. The locator 20 has an eye 21 at its upper end and its lower end 22 extends through a hole 22' in the lever guard 18. A headed fastener 23 extends through the eye 21 and affixes the upper end of the locator 20 to the body 11.

The lower end of the locator 20 is restrained by the hole 22' in the lever guard 18.

The locator 20 has one or more protuberances 24 and 25 formed in it. The lever 15 has a sear 26 on its distal end and the sear 26 selectively rests on the protuberances 24 or 25, depending upon the position to which the operator moves the lever 15 by hand pressure.

The protuberances have a top surface 27 inclined downwardly and toward the lever 15 so that as the spring on the stem 16 urges the lever to the full-closed position shown in FIG. 1, a lateral component of that force urges the lever to slide off of the protuberance. Sideward hand pressure on the lever overcomes this force.

The preferred angle for the surface 27 of the protuberance is 22° to the horizontal.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. A dispensing nozzle for filling a container comprising, a nozzle body having an inlet and an outlet, valve means for controlling the flow of fluid from said inlet to said outlet, a lever connected to said valve means for moving said valve means to open position, a handle on said lever, resilient means on said body urging said valve means to closed position, a locator having upwardly facing protuberances thereon supported on said nozzle body and disposed laterally of said lever, said lever having a sear on the distal end thereof adapted to rest on said protuberances when said lever is moved to move said valve to open position, said protuberances each having a top surface thereon inclined downward and towards said lever at an angle of approximately 22°, said angle being sufficient to provide a lateral force component on said lever sufficient to overcome the force of friction due to the reaction of said resilient means urging said valve means to closed position whereby an operator can manually move said valve to open position with said lever and then move said lever laterally onto said inclined surface whereby the frictional force of said lever on said inclined surface supplies a part of the force necessary to hold lever from sliding off said surface holding said valve in said open position and said lever will slide laterally from said inclined surface when no manual force supplementing said frictional force on said lever is provided, allowing resilient means to close said valve.

* * * * *